United States Patent [19]

Hansen

[11] 4,155,322

[45] May 22, 1979

[54] APPARATUS FOR USE IN THE JOINTING OF FLOATING SHIP SECTIONS

[76] Inventor: Reidar S. Hansen, Damveien 36, Kråkerøy, Fredrikstad, Norway

[21] Appl. No.: 815,380

[22] Filed: Jul. 13, 1977

[51] Int. Cl.[2] ..... B63C 9/00

[52] U.S. Cl. ..... 114/45; 114/77 R

[58] Field of Search ..... 114/45, 46, 65 R, 77 R, 114/77 A, 79 R, 79 W; 61/64–68, 81–82

[56] References Cited

U.S. PATENT DOCUMENTS

| | | | |
|---|---|---|---|
| 657,660 | 9/1900 | Jamieson | 114/46 |
| 3,433,198 | 3/1969 | Yamada et al. | 114/77 R |
| 3,585,954 | 6/1971 | Muto et al. | 114/77 R |
| 3,611,968 | 10/1971 | Takezawa | 114/77 R |
| 3,638,437 | 2/1972 | Fukuda | 114/45 |

*Primary Examiner*—Trygve M. Blix
*Assistant Examiner*—Jesus D. Sotelo
*Attorney, Agent, or Firm*—William Anthony Drucker

[57] ABSTRACT

There is provided a floating caisson device for placing below and transversely to the bottom of a vessel hull in engagement with the lower portions of the hull side walls for providing a dry working space, especially for joining floating hull sections by welding, comprising a bottom channel with side wall members at the ends thereof, at least one side wall member being able to be brought into sealing engagement with the hull side wall, packing for sealing between the device and the hull, and ballast tanks for controlling the buoyancy of the device. Between at least one side wall member and the adjacent end of the bottom channel there is provided a flexible transition member conforming to the curvature of the hull for sealing engagement therewith when the side wall member is moved against the hull side, the packing being continuously extending along each side edge of the bottom channel, the transition member and the side wall member.

3 Claims, 5 Drawing Figures

APPARATUS FOR USE IN THE JOINTING OF FLOATING SHIP SECTIONS

Figure 1:
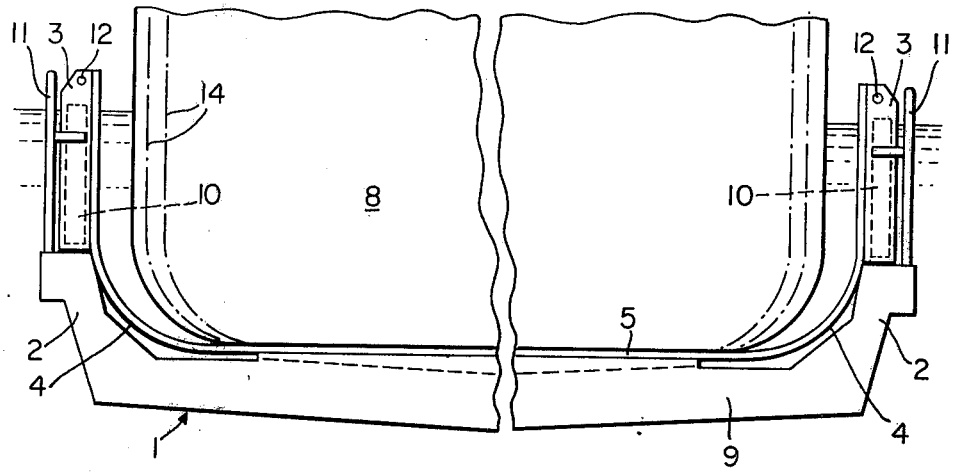

The present invention relates to a floating caisson device for placing below and transversely to the bottom of a vessel hull in engagement with the lower portions of the hull side walls for providing a dry working space, especially for joining floating hull sections by welding, comprising a bottom channel consisting of one or more rigid members, and side wall members provided at each end thereof, at least one of said side wall members being movably arranged to be able to be brought into sealing engagement with the hull side wall, packing means being provided for sealing between the floating caisson device and the adjacent hull surfaces, and ballast tanks capable of being filled or emptied to change the buoyancy of the device.

In connection with the building of ships consisting of several sections connected to each other in floating condition there are known a variety of devices for providing a dry working space for the jointing of the sections. Such devices comprise a channel structure placed outside the welding zone below the adjacent ship sections and extending from one ship side to the other with a sealing packing which is arranged on each side of the welding zone. After the placing of the channel structure the water is pumped out thereof so that the channel is urged upwards against the ship as a result of the buoyancy. The ends of the channel extend upwards above the water surface on each side of the ship so that a dry space appears wherein jointing, e.g. by welding, can be carried out as under normal conditions.

Such channels are usually carried out as rigid constructions, advantageously divided in several sections, especially adapted for the cross-section which is to be enclosed.

Further, there are known several methods for enabling the mounting of such channels. One method consists in that several rigid members, which are each provided with packings, are joined in subaqueous position by means of divers.

One of the reasons for dividing such channels in several sections, is that a rigid, continuous channel is very difficult to install by initially lowering the channel and subsequently raise it to engagement with the adjacent ship sections. The difficulties are primarily due to the fact that the sides of the ship are usually parallel above the bilge of the ship in the zone wherein the jointing is carried out. Consequently, when raising the channel, the packings which are to seal against the ship and which, prior to the mounting, extend a distance beyond the position which they are to have after the mounting, will hit or run against the ship sides and prevent the placing and therewith make the sealing difficult.

When using rigid channels such as described above, several undesirable circumstances arise. The packing is subdivided in several parts, and in addition one gets several joints on the channel which also increases the risk of leakage. The necessity of utilizing diver assistance must also be said to be a draw-back. For the above reasons it is evident that a one-piece channel with continuous packing against the jointing zone is a substantially better and more safe solution than corresponding divided-up channels and packings.

A floating caisson device wherein there is used one channel consisting of several rigid members, and which is of the type set forth above, is for example known from Norwegian patent No. 128 260. In this device a corner section is arranged between the bottom channel and the side wall members at the ends of the floating caisson, the corner section at the inner surface of the floating caisson being hinged to both the bottom channel and the adjacent side wall member, and the corner section being tightly connected to the adjacent members by means of bellows-like means. This construction enables easy installation of the device, but the device is limited to use on a special ship cross-section with a special curvature of the bilge, and thus it is not flexible for being able to be used for varying curvatures of the bilge and to cover several ship widths.

It is therefore an object of the present invention to provide a floating caisson device for use in the jointing of floating ship sections and the like, which is of a construction enabling that the device can be utilized right away on ships with different widths and with different curvature of the bilge, at the same time as it may be installed in a quick, easy and safe way.

The above object is achieved with a device of the type set forth above which, according to the invention, is characterized in that between at least one side wall member and the adjacent end of the bottom channel there is provided a flexible transition member which, by movement of the side wall member towards the hull side, conforms to the curvature of the hull for sealing engagement with the hull side, said packing means being continuous and extending along each side edge of the bottom channel, the transition member and the side wall member.

Figure 2:
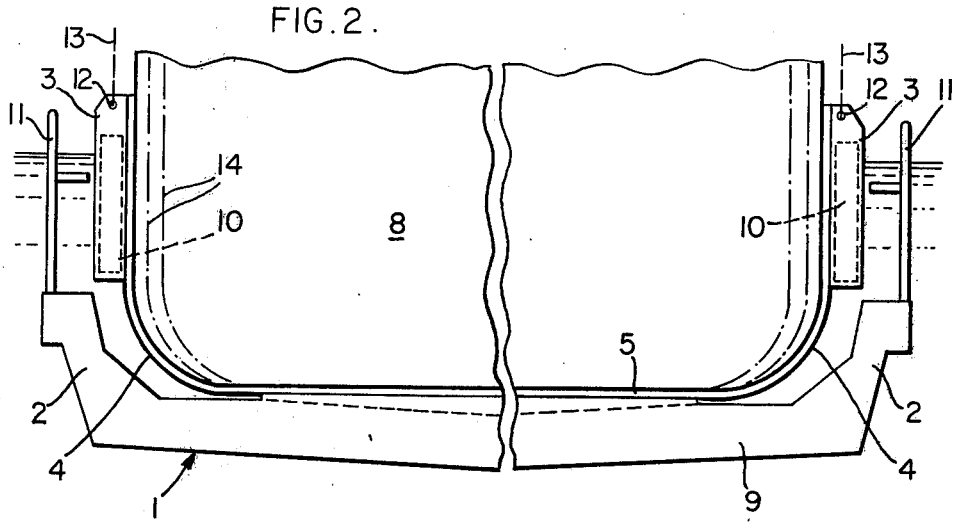
Figure 3:
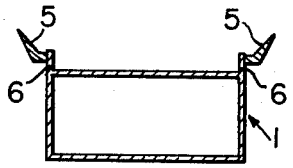
Figure 4:
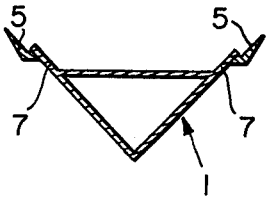
Figure 5:
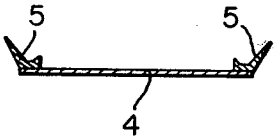

The invention will be more closely described in the following with reference to the accompanying drawings which shows an exemplary embodiment of the device according to the invention, and wherein FIG. 1 shows a schematic side view of a device according to the invention installed below a floating hull section, FIG. 2 shows the device in FIG. 1 in working position, FIGS. 3 and 4 show examples of cross-sectional forms of the bottom channel, and FIG. 5 shows an example of a cross-section of the flexible transition member.

In the shown embodiment the floating caisson device comprises a rigid, straight bottom channel 1 which at each end is provided with a supporting member 2 which is adapted to support a respective side wall member 3. Between each end of the bottom channel 1 and the associated side wall member 3 there is provided a flexible transition member 4 which may e.g. consist of a plate of steel or another flexible, strong and durable material. As shown in the drawing, along each upper side edge of the bottom channel 1, the transition members 4 and the side wall members 3 there is provided a sealing means or packing 5 which are preferably continuous in its entire length. The packings may e.g. be secured by means of a longitudinally extending iron strip or the like (not shown) which is attached by means of bolts or the like (not shown) so that the packings are pressed tightly against the substructure. The packings 5 may in the said way be attached to e.g. upwards or outwards extending flanges extending along the side edges of the bottom channels and the side wall members. In FIGS. 3 and 4 such flanges on the bottom channel 1 are designated by 6 and 7, respectively.

Such as appears from FIGS. 1 and 2, the supports 2 are located so that the flexible transition members 4 and the side wall members 3 can be held at a distance from the sides of the hull sections of the vessel 8 in question, so that the rigid channel 1 can be placed against the welding zone first and without the flexible members touching this zone. The rigid bottom channel 1 is provided with buoyancy or ballast tanks 9 which can be filled and emptied of water in order to change the buoyancy of the device. In the shown embodiment the whole inner space of the bottom channel constitutes such a ballast tank 9, but alternatively separate tanks may be provided within the bottom channel. Also the side wall members 3 are preferably provided with ballast tanks 10 (suggested with dashed lines) for the corresponding purpose. Suitable conduits (not shown) for said filling and emptying are coupled to the various ballast tanks.

Prior to the installation of the floating caisson device the side wall members 3 and the flexible transition members 4 connected thereto are detachably secured to the supports 2 of the bottom channel 1. For this purpose there are shown securing or holding means 11 which may also be used as attachment means for crane hooks or the like when the device is hoisted in place by means of cranes and is placed below the hull sections which are to be joined.

In FIGS. 3 and 4 there are shown examples of cross-sectional forms of the rigid or stiff bottom channel 1. In FIG. 3 the channel is shown to have square cross-section and flanges 6 extending upwards from the side edges for attachment of the packings 5. Instead of extending upwards said side flanges may extend horizontally outwards from the upper side edges of the channel. In FIG. 4 there is shown a triangular cross-section wherein upper extensions of the side faces of the channel constitute fastening flanges 7 for the packings 5.

The device is installed in that initially it is submerged in the water to a desired level by pumping water into the ballast tank or tanks 9. When the bottom channel 1 is placed in proper position, the water is pumped out and the channel is lifted and urged upwards against the hull sections as a result of the buoyancy of the water. The packings 5 on the upper side of the channel then seal against the hull. When the rigid bottom channel is placed in proper position, the side wall members 3 are released and by means of their ballast tanks 10, which are empty at this time, the side wall members float upwards and pull the flexible transition members 4 inwards against the bilge of the hull 8 and upwards along the hull side, so that the flexible members conform to the bilge of the hull and the associated lengths of the packings 5 seal against the hull side.

As an additional security the side wall members 3 may be provided with means for connection with stretching means for pulling the side wall members into sealing engagement with the hull sides in the working position of the device. Said means may e.g. consist of lugs with fastening holes 12 for mounting of crane cables 13 (shown with dashed lines in FIG. 2) or the like.

When the device has been installed as described, the water is pumped out of the device, also the water flowing into the channel from the compartments of the ship communicating with the jointing zone. When the water has been removed so that a dry space is formed in the jointing zone, the jointing may start.

In the exemplary embodiment shown in the drawing, there is shown a ship hull 8 with straight bottom portion and rounded bilges. In FIGS. 1 and 2 varying ship widths and varying bilge curvatures are suggested with dash-dotted lines 14. The device according to the invention may, however, also be used in connection with hull sections with V-shaped bottom and otherwise for submarine structures wherein the principle of combining rigid and flexible members of a channel such as described above, can be used. Thus, the orientation of the rigid and flexible members in relation to each other and the choice of material in the flexible members will be without any importance for the application of the principle according to the invention.

By utilization of the device according to the invention jointing of hull sections can be carried out quicker as well as more economically and securely than is possible with the devices according to the prior art. As stated above the device according to the invention may be utilized straight away in connection with ships of various width and with different curvature of the bilge. No assembly work is required under water and no diver assistance. The device may be handled and transported as a rigid structure due to the end supports, even if it also comprises flexible members. Further, the device is economic in production as no special components are required. Also the flexibility is obtained by use of the same metallic material as that of which the rest of the channel device is constructed.

What I claim is:

1. In a floatable device for placing below and transversely to a hull, having side walls and a bottom, in watertight engagement therewith, particularly for use when joining floating sections of a ship's hull, said device comprising:

(I) a rigid bottom channel, (II) a side wall member associated with each end of said bottom channel and adapted to be brought into sealing engagement with the hull side walls, (III) packing means on said bottom channel and said side wall members for sealing respectively against the hull bottom and the hull side walls, and (IV) ballast tanks for controlling buoyancy of the device, the improvement comprising:

(a) a flexible metal transition plate connecting each of said side wall members to the associated bottom channel end and having packing means disposed along side edges thereof, (b) a support projecting from each end of said bottom channel for releasably supporting an associated of said side wall members, each of said side wall members being releasably securable to the associated support for retaining said side wall member temporarily at a distance from the adjacent hull side wall during placing of the device below and transversely to the hull, and (c) means for raising said side wall members from said supports to pull said flexible transition plate upwards and into sealing engagement with the hull sides.

2. A floatable device as claimed in claim 1, wherein said raising means comprises at least one ballast tank located in each of said side wall members.

3. A floatable device as claimed in claim 1, wherein said raising means comprises a stretching means for pulling each of said side wall members and the transition plates upwards and into sealing engagement with the hull side walls.

* * * * *